US005581979A

United States Patent [19]

Scherer

[11] Patent Number: 5,581,979

[45] Date of Patent: Dec. 10, 1996

[54] METHOD AND APPARATUS FOR APPLYING A CONSTANT TENSION TO A FILM

[75] Inventor: Philip G. Scherer, Fort Lauderdale, Fla.

[73] Assignee: Mima Incorporated, Glenview, Ill.

[21] Appl. No.: 358,849

[22] Filed: Dec. 19, 1994

[51] Int. Cl.[6] ..... B65B 13/12

[52] U.S. Cl. ..... 53/441; 53/556; 53/389.4

[58] Field of Search ..... 53/556, 389.2, 53/389.4, 588, 441

[56] References Cited

U.S. PATENT DOCUMENTS

| | | |
|---|---|---|
| 3,032,943 | 5/1962 | Reimers et al. . |
| 3,145,945 | 8/1964 | Bowen, Jr. . |
| 3,251,294 | 5/1966 | Hill et al. . |
| 3,379,121 | 4/1968 | Lems . |
| 3,557,925 | 1/1971 | Zulauf . |
| 3,759,432 | 9/1973 | Hutzenlaub . |
| 4,514,955 | 5/1985 | Mouser et al. . |
| 4,706,443 | 11/1987 | Humphrey . |
| 4,712,354 | 12/1987 | Lancaster et al. . |
| 4,756,143 | 7/1988 | Lancaster . |
| 4,905,448 | 3/1990 | Plitt . |
| 4,934,123 | 6/1990 | Salzsaüler . |
| 4,938,008 | 7/1990 | Salzsauler . |
| 4,979,358 | 12/1990 | Kelp . |
| 5,027,579 | 7/1991 | Kelp . |
| 5,163,264 | 11/1992 | Hannen . |
| 5,311,725 | 5/1994 | Martin et al. . |
| 5,351,905 | 10/1994 | Ferber . |

OTHER PUBLICATIONS

Highlight Industries, Inc., "Synergy 2 With Hydro–Stretch", 1991.

*Primary Examiner*—Linda Johnson
*Attorney, Agent, or Firm*—Schwartz & Weinrieb

[57] ABSTRACT

A method and apparatus for applying a constant tension to a film in a wrapping machine having a film roller rotated at a variable rate by a film drawn over the film roller. The rotating film roller drives a hydraulic pump at a variable rate dependent on the rotation rate of the film roller. An oil reservoir is coupled to the hydraulic pump to form a hydraulic circuit, wherein the hydraulic pump pumps oil through the hydraulic circuit as the film roller drives the hydraulic pump. An adjustable constant pressure valve is coupled to the hydraulic circuit and maintains a constant oil pressure in the hydraulic circuit, wherein the hydraulic pump maintains a constant drag on the film roller independent of the rate at which the film roller drives the hydraulic pump, and wherein the constant drag on the film roller applies a constant tension to the film independent of the rate at which the film is drawn over the film roller.

12 Claims, 2 Drawing Sheets

METHOD AND APPARATUS FOR APPLYING A CONSTANT TENSION TO A FILM

FIELD OF THE INVENTION

The present invention generally relates to a method and apparatus for applying a constant tension to a film, and, more specifically, to a drag brake for applying a constant tension to a film in a film wrapping machine.

BACKGROUND OF THE INVENTION

Film wrapping machines are used for applying a film to a load often comprising one or more articles stacked on a pallet. The wrapping machine generally comprises a stretch head with a film supply roll, wherein the stretch head and load are moved in relation to one another to supply the film from the film supply roll and wrap the film about the load. In some wrapping machines, a moving stretch head orbits a fixed load, and in other wrapping machines the load is rotated on a turntable in relation to a fixed stretch head. As the film is wrapped around the load, the stretch head applies a tension to the film that varies dependent on the relative motion between the load and stretch head, and on the shape of the load. Known stretch heads include a film roller to provide a tension on the film, wherein the film is drawn over and frictionally engages the film roller as it is applied to the load. For example, U.S. Pat. No. 5,163,264 discusses a film roller that drives a hydraulic pump which provides resistance or drag on the film roller. The pump is coupled to a hydraulic circuit with a fixed orifice pressure valve which imparts resistance to the fluid pumped through the circuit, to the pump, to the film roller, and ultimately to the film drawn over the film roller. Known film rollers, however, have the disadvantage that they provide a variable tension on the film. More specifically, the tension on the film and the corresponding force on the load increases and decreases in relation to the increasing and decreasing rate, respectively, at which the film is drawn over the film roller and applied to the load. The shape of the load, for example, corners of a square load, also affects the rate at which the film is drawn over the film roller and applied to the load. To ensure secure packaging of the load, the film must be applied at some minimum tension which may not be reached until the relative motion between the load and the stretch head reaches some threshold value after start-up of the wrapping machine. The delay required to apply sufficient tension to the film for proper wrapping, however, increases the time and material required to package the load. Similar inefficiencies result after shut-down of the film wrapping machine since the wrapping machine cannot be stopped instantaneously. Further, the rate at which the film is applied to the load is limited by the force that the load can withstand without being tipped over by the film. Also, some loads may be damaged by a high tension film which crushes the packaging comprising the load.

In the past it has been proposed to pre-stretch the film prior to applying the film to the load so as to reduce the force applied to the load. Pre-stretching the film however requires a motor driven pre-stretching apparatus generally comprising at least two rollers with different rotation rates to stretch the film. A power pre-stretching apparatus substantially increases the cost of a film wrapping machine. Further, pre-stretching the film only reduces the force on the load, and does not overcome the other problems related to inefficiency during wrapping machine start-up and shut-down, limitations on the film wrapping rate, and variations in the film tension resulting from the shape of the package. Existing methods of controlling the film tension include controlling amount of pre-stretching based on a measurement of film tension at the load by changing motor speed. These control methods however are complex and expensive, and are often not adequately responsive to changes in measured film tension as a result of the delay in feedback processing and the effect of momentum on the time required to change motor speed.

In view of the discussion above, there exists a demonstrated need for an advance in the art of a applying a constant tension to a film in a film wrapping machine.

OBJECTS OF THE INVENTION

It is therefore an object of the present invention to provide a novel method and apparatus for applying a constant tension to a film in a wrapping machine.

It is another object of the present invention to provide a novel method and apparatus for applying a constant tension to a film in a wrapping machine that is economical and highly responsive to factors that affect film tension.

It is a further object of the present invention to provide a novel method and apparatus for a hydraulic drag brake which applies a constant tension to a film roller in a wrapping machine, wherein the film roller applies a constant tension to a film drawn over the film roller independent of film application rate and package shape.

It is also an object of the present invention to provide a novel method and apparatus for a hydraulic drag brake which applies a constant tension to a film roller in a wrapping machine, wherein the hydraulic drag brake includes a hydraulic circuit with an adjustable constant pressure valve.

SUMMARY OF THE INVENTION

Accordingly, the present invention is directed toward a novel method and apparatus for applying a constant tension to a film in a film wrapping machine having a film roller rotated at a variable rate by a film drawn over the film roller. The rotating film roller drives a hydraulic pump at a variable rate dependent on the rotation rate of the film roller. An oil reservoir is coupled to the hydraulic pump to form a hydraulic circuit, wherein the hydraulic pump pumps oil through the hydraulic circuit as the film roller drives the hydraulic pump. A constant pressure valve is coupled to the hydraulic circuit and maintains a constant oil pressure in the hydraulic circuit, wherein the hydraulic pump maintains a constant drag on the film roller independent of the rate at which the film roller drives the hydraulic pump, and wherein the constant drag on the film roller applies a constant tension to the film independent of the rate at which the film is drawn over the film roller. In one embodiment, the hydraulic circuit includes an oil filter to remove contaminants from the oil and to prevent contaminants from entering the constant pressure valve. In another embodiment, the constant pressure valve is adjustable to adjust the oil pressure in the hydraulic circuit and to adjust the constant drag on the film roller which applies a constant tension to the film independent of the rate at which the film is drawn over the film roller. The tension of the film of the present invention is therefore not affected by variations in the rate of film wrapping, and the shape of the articles or packaging.

BRIEF DESCRIPTION OF THE DRAWINGS

These and other objects, features and advantages of the present invention will become apparent upon consideration of the following Detailed Description of the invention with the accompanying drawings, in which like reference characters designate like or corresponding parts throughout the several views, and wherein.

DETAILED DESCRIPTION OF THE INVENTION

Figure 2:
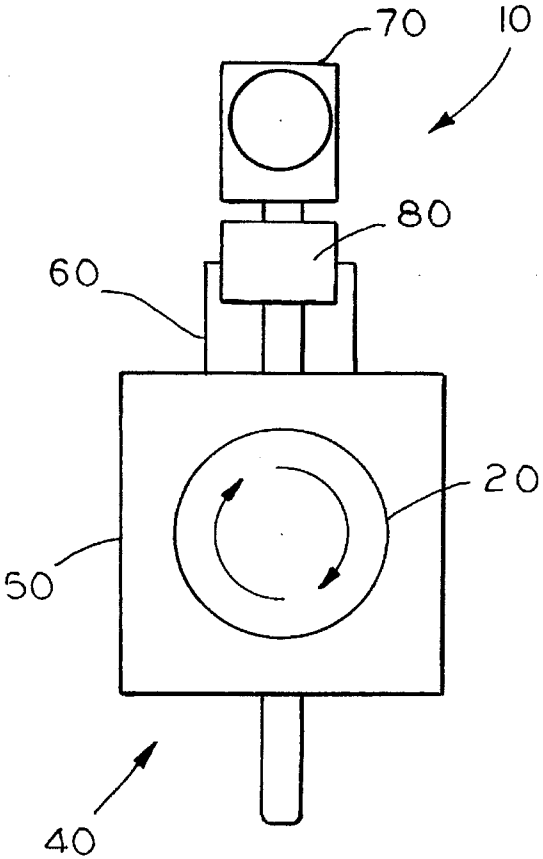
FIG. 2 is a side view of the hydraulic drag brake for a film roller of FIG. 1.
Figure 1:
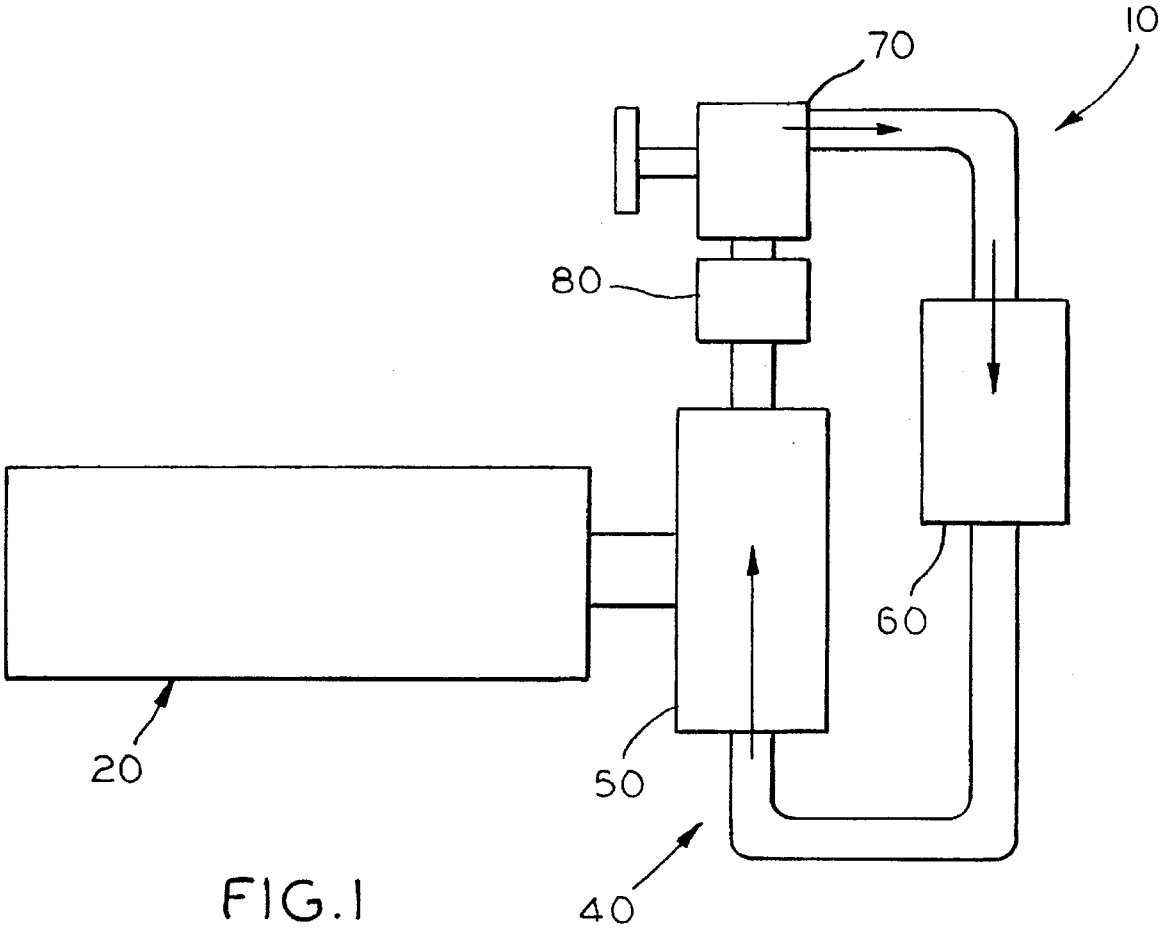
FIG. 1 is a plan view of an apparatus for applying a constant tension to a film, and in particular a hydraulic drag brake for a film roller.

FIGS. 1 and 2 illustrate a hydraulic brake 10 for a film roller generally comprising a film roller 20 rotated by a film 30 drawn over the film roller 20. The film roller 20 is coupled to a hydraulic circuit 40 which applies a constant drag to the film roller 20 and thereby applies a constant tension to the film 30 drawn over the film roller 20. In an exemplary embodiment, the hydraulic brake 10 for a film roller is applied to a film wrapping machine for wrapping a film about a load wherein the hydraulic drag brake for the film roller applies a constant tension to the film independent of the rate at which the film is wrapped about the load, and of the shape of the articles that comprise the load.

The hydraulic circuit 40 includes a hydraulic pump 50, an oil reservoir 60 and a constant pressure valve 70 interconnected by a conduit. The film roller 20 is coupled to the hydraulic pump 50 by a direct drive shaft, chain, belt or other known coupling means. The film roller 20 is rotated at a variable rate as the film 30 is drawn over and frictionally engages the film roller 20 depending on relative motion between the load and the stretch head and the shape of the package. The coupling means transfers the rotational energy from the rotating film roller 20 and drives the hydraulic pump 50, at a rate dependent on the rotational rate of the film roller 20, which pumps oil from the oil reservoir 60 through the hydraulic circuit 40. The constant pressure valve 70 regulates the oil pressure in the hydraulic circuit 40 so as to maintain a constant pressure independent of the rate at which the film roller 20 drives the hydraulic pump 50, wherein the hydraulic pump 50 maintains a constant resistance or drag on the film roller 20 which applies a constant tension to the film 30 as the film is drawn over the film roller 20. In one embodiment, the constant pressure valve 70 is adjustable to adjust the oil pressure in the hydraulic circuit 40, and to thereby adjust the tension applied to the film 30 drawn over the film roller 20. An adjustable constant pressure valve suitable for application in the present invention is available from Sun Hydraulics. In another embodiment, the hydraulic circuit 40 includes an oil filter 80 to remove contaminants from the oil and prevent the contaminants from flowing through the constant pressure valve 70.

Figure 3:
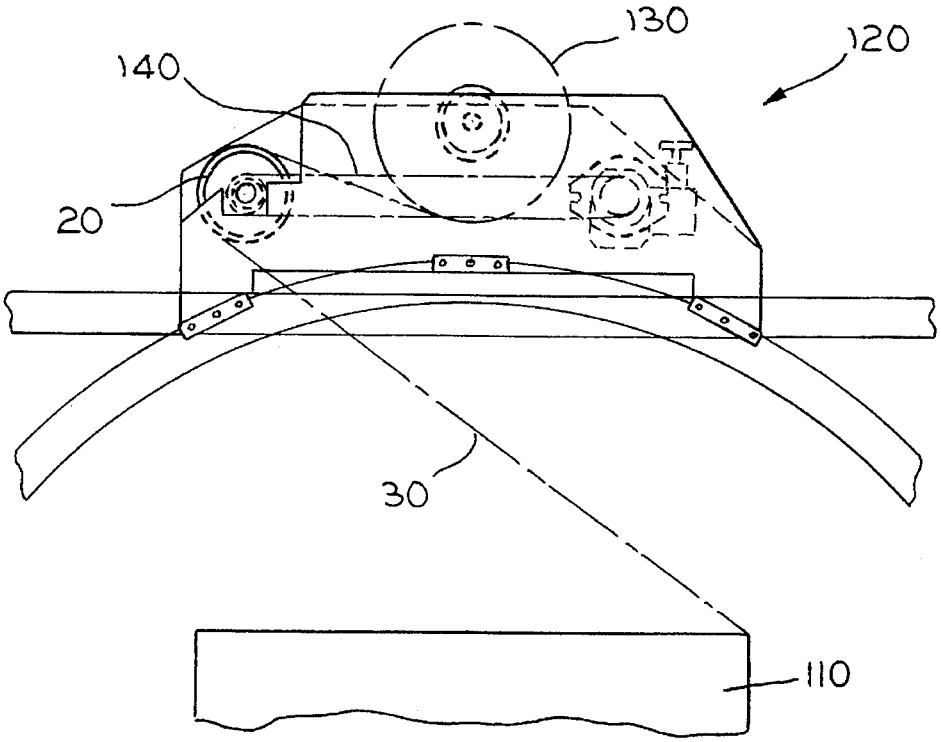
FIG. 3 is a partial plan view of the hydraulic drag brake of the present invention applied to a film wrapping machine.
Figure 4:
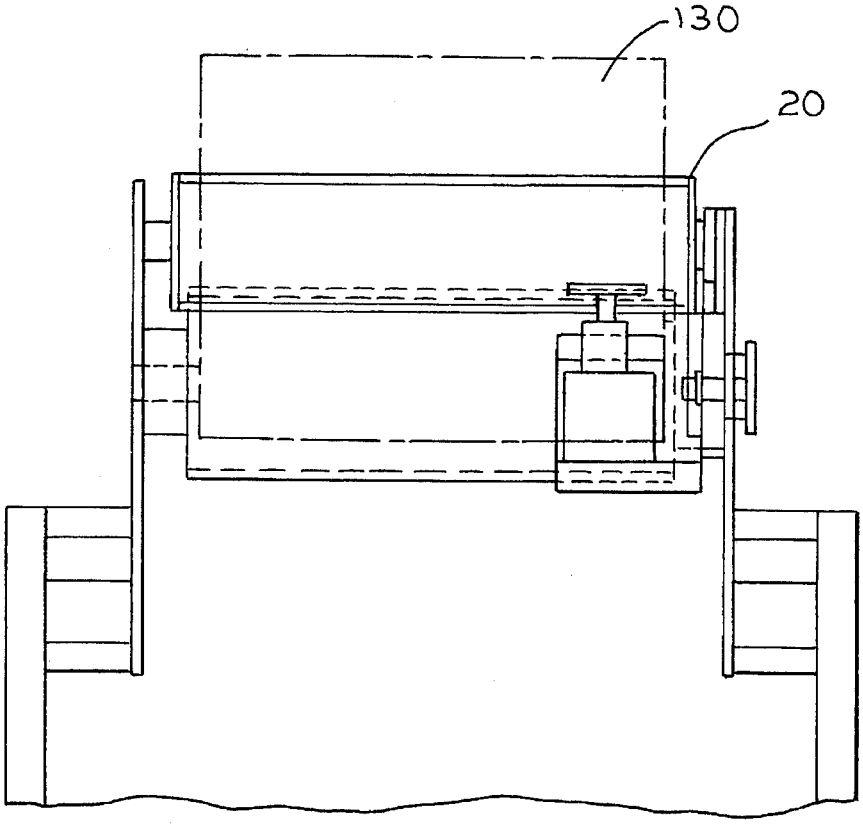
FIG. 4 is a partial side view of FIG. 3.

The hydraulic brake 10 for a film roller is useful for applying a constant tension to a film in a film wrapping machine, including turntable type wrapping machines, wherein the load is rotated on a platform in relation to a fixed stretch head, and in ring type wrapping machines and orbiting type wrapping machines, wherein the stretch head is moved in relation to a load. In the exemplary embodiment of FIGS. 3 and 4, a stretch head 120 includes a film supply roll 130 and a rotatable film roller 20 mounted thereon. As the stretch head 120 moves in relation to the load 110, the film 30 is withdrawn from the film supply roll 130 and is applied about the load 110. The film 30 is drawn over and frictionally engages the film roller 20 which is coupled by a coupling means 140 to the hydraulic drag brake 10 so as to apply a constant tension to the film roller 20 and accordingly the film 30 independent of the rate at which the film 30 is drawn over the film roller 20 and independent of the shape of the packaging. In another embodiment, the stretch head 120 includes a power film stretcher, not shown in the drawing, for pre-stretching the film 30 before the film 30 is drawn over the film roller 20.

The foregoing is a description enabling one of ordinary skill in the art to make and use the preferred embodiments of the present invention. It will be appreciated by those skilled in the art that there exists variations, modifications and equivalents to the embodiments disclosed herein. The present invention is therefore to be limited only by the scope of the appended claims, and within the scope of such claims, the present invention may be practiced otherwise than as specifically described.

What is claimed is:

1. A hydraulic drag brake for a film roller, comprising:

a film roller rotated by means of a film drawn over said film roller wherein said film rotates said film roller at a variable rate of speed dependent upon the rate of speed at which said film is drawn over said roller;

a hydraulic pump operatively connected to said film roller such that said rotating film roller drives said hydraulic pump at a variable rate of speed dependent upon the rotation rate of said film roller;

an oil reservoir fluidically connected to said hydraulic pump so as to form therewith a hydraulic circuit wherein said hydraulic pump pumps oil through said hydraulic circuit as said film roller drives said hydraulic pump; and constant pressure valve means incorporated within said hydraulic circuit for maintaining a constant oil pressure within said hydraulic circuit whereby said hydraulic pump maintains a constant drag upon said film roller independent of the rate at which said film roller drives said hydraulic pump, and wherein further said constant drag impressed upon said film roller applies a constant tension to said film independent of the rate at which said film is drawn over said film roller.

2. A hydraulic brake according to claim 1, wherein:

said constant pressure valve means is adjustable so as to adjust said oil pressure within said hydraulic circuit and thereby maintain said constant drag upon said film roller which, in turn, applies said constant tension to said film independent of said rate of speed at which said film is drawn over said film roller.

3. A hydraulic drag brake according to claim 1, further comprising:

an oil filter incorporated within said hydraulic circuit for removing contaminants from said oil so as to prevent contaminants from entering said constant pressure valve means.

4. A hydraulic drag brake according to claim 3, wherein:

said constant pressure valve means is adjustable so as to adjust said oil pressure within said hydraulic circuit and thereby maintain said constant drag upon said film roller which, in turn, applies said constant tension to said film independent of said rate of speed at which said film is drawn over said film roller.

5. A film wrapping machine for wrapping a film about a load, comprising:

a stretch head having a film supply roll operatively connected thereto;

means for moving said stretch head with respect to a load whereby said stretch head applies film from said film supply roll to said load as said stretch head is moved with respect to said load;

a film roller operatively connected to said stretch head and rotated by said film as said film is drawn over said film roller wherein said film rotates said film roller at a variable rate of speed dependent upon the rate of speed at which said film is drawn over said film roller;

a hydraulic pump operatively connected to said film roller such that said rotating film roller drives said hydraulic pump at a variable rate of speed dependent upon the rotation rate of said film roller;

an oil reservoir fluidically connected to said hydraulic pump so as to form therewith a hydraulic circuit wherein said hydraulic pump pumps oil through said hydraulic circuit as said film roller drives said hydraulic pump; and constant pressure valve means incorporated within said hydraulic circuit for maintaining a constant oil pressure within said hydraulic circuit whereby said hydraulic pump maintains a constant drag upon said film roller independent of the rate of speed at which said film roller drives said hydraulic pump, and wherein further said constant drag impressed upon said film roller applies a constant tension to said film independent of the rate of speed at which said film is drawn over said film roller.

6. A film wrapping machine according to claim 5, wherein:

said constant pressure valve means is adjustable so as to adjust said oil pressure within said hydraulic circuit and thereby maintain said constant drag upon said film roller which, in turn, applies said constant tension to said film independent of said rate of speed at which said film is drawn over said film roller.

7. A method for applying a constant tension to a film in a film wrapping machine, comprising the steps of:

drawing a film over a film roller so as to rotate said film roller at a variable rate of speed dependent upon the rate of speed at which said film is drawn over said film roller;

operatively connecting a hydraulic pump, incorporated within a hydraulic circuit, with said rotating film roller such that said hydraulic pump is driven by said film roller at a rate of speed which is dependent upon the rotational rate of speed of said film roller whereby said hydraulic pump pumps oil through said hydraulic circuit; and maintaining a constant oil pressure within said hydraulic circuit independent of the rate of speed at which said film roller drives said hydraulic pump so as to maintain a constant drag upon said film roller and thereby apply a constant tension to said film independent of the rate of speed at which said film is drawn over said film roller.

8. A method according to claim 7, further comprising the steps of:

constantly adjusting the pressure within said hydraulic circuit so as to maintain said pressure within said hydraulic circuit constant and thereby maintain said drag upon said film roller constant so as to, in turn, maintain said tension upon said film constant independent of the rate of speed at which said film is drawn over said film roller.

9. A method according to claim 7, further comprising the step of:

maintaining said constant oil pressure within said hydraulic circuit by incorporating a constant pressure valve within said hydraulic circuit.

10. A method according to claim 7, further comprising the step of:

maintaining said constant oil pressure within said hydraulic circuit by incorporating an adjustable constant pressure valve within said hydraulic circuit.

11. A film wrapping machine as set forth in claim 5, further comprising:

oil filter means incorporated within said hydraulic circuit for removing contaminants from said oil so as to prevent contaminants from entering said constant pressure valve means.

12. A method as set forth in claim 9, further comprising the step of:

incorporating an oil filter within said hydraulic circuit so as to remove contaminants from said oil and thereby prevent contaminants from entering said constant pressure valve.

* * * * *